US007972073B2

(12) United States Patent
Vintimiglia

(10) Patent No.: US 7,972,073 B2
(45) Date of Patent: Jul. 5, 2011

(54) COSMETIC PRODUCT DISTRIBUTOR APPLICATOR

(75) Inventor: Anne-Sophie Vintimiglia, Marseilles (FR)

(73) Assignee: Natura Cosmeticos S.A. (BR)

( * ) Notice: Subject to any disclaimer, the term of this patent is extended or adjusted under 35 U.S.C. 154(b) by 0 days.

(21) Appl. No.: 12/204,873

(22) Filed: Sep. 5, 2008

(65) Prior Publication Data

US 2009/0067913 A1 Mar. 12, 2009

(30) Foreign Application Priority Data

Sep. 7, 2007 (FR) ..... 07 06275

(51) Int. Cl.
*A46B 11/00* (2006.01)

(52) U.S. Cl. ..... 401/129; 401/126

(58) Field of Classification Search ..... 401/126–130
See application file for complete search history.

(56) References Cited

U.S. PATENT DOCUMENTS 3,147,511 A * 9/1964 Pittoni ..... 401/128
4,444,324 A * 4/1984 Grenell ..... 215/6
5,349,972 A * 9/1994 Dirksing et al. ..... 132/218
6,682,242 B1 1/2004 Montoli
6,702,494 B2 3/2004 Dumler et al.
2006/0102192 A1 5/2006 Fischer et al.

FOREIGN PATENT DOCUMENTS

CH 158 665 11/1932
DE 74 33 846 4/1975
GB 960 929 6/1964

OTHER PUBLICATIONS

French Search Report, FR 0706275 (FA700592), dated May 16, 2008.

* cited by examiner

*Primary Examiner* — David J Walczak
(74) *Attorney, Agent, or Firm* — Banner & Witcoff, Ltd.

(57) ABSTRACT

The mascara distributor applicator (1) includes: a) a container (3) including a neck (7) threaded externally and a chamber (5) extending in an axial direction with a side wall (6), b) an applicator (8) including a head (9) threaded internally so as to cooperate with the neck by screwing to ensure a sealed closing of the container, a stem (10) attached by its upper extremity to the head and by its lower extremity to a means of application (11). The applicator also includes: c) a hollow outer envelope (21) with at least one opening (28) and at the inside of which the container is fixed in a removable way and d) a hollowed-out cover with at least one opening (25) and inside which the applicator of the cosmetic product is fixed in a removable way.

14 Claims, 7 Drawing Sheets

COSMETIC PRODUCT DISTRIBUTOR APPLICATOR

FIELD OF INVENTION

The invention concerns the field of distributor applicators destined for conditioning of fluid or pasty products, typically cosmetic products, for example mascaras or liquid lipsticks.

BACKGROUND OF RELATED ART

There are already a large number of documents showing distributor applicators of a fluid or pasty cosmetic product such as a mascara.

These distributor applicators generally include:

a body including a container for the said cosmetic product with a neck threaded externally and with a wiper.

an applicator of the said cosmetic product including a head forming a means of closing the said applicator, the said head being typically threaded inside so as to cooperate with the said neck by screwing to ensure sealed closing of the said body, a stem attached by its upper extremity to said head and by its lower extremity to a means of application. Typically, the container is generally a plastic molded part, the wiper being a separate part, typically in polyethylene or elastomer, clipped, glued or welded in the neck. The wiper is typically of a diameter chosen to allow passage of the stem and to wring out the means of application, for example a blush soaked in the product to apply, each time the applicator is taken from the container.

For information on applicator distributors, those described in the following French patents may be cited: FR 2 850 549, FR 2 796 532, FR 2 796 530, FR 2 779 041, FR 2 771 907, FR 2 762 494, FR 2 745 481, FR 2 648 686 and FR 2 627 068.

PROBLEMS POSED

The distributor applicators according to the invention aim to simultaneously resolve a plurality of problems:

on the one hand, they aim to facilitate the design and manufacture of the body whose outside appearance must be impeccable, for example lacquered, brilliant, with inscriptions, and the material in contact with the mascara compatible with the mascara formula and showing for example barrier properties;

on the other hand, they aim to limit the quantity of waste products and to facilitate the recycling of this waste;

finally, they aim to offer alternatives, in relation to distributor applicators, of the background of the related art, in such a way as to renew the offer of new products, which is a necessity in a field where the product life is relatively low.

DESCRIPTION OF THE INVENTION

According to the invention, the distributor applicator of a cosmetic product that is typically fluid or pasty, for example a mascara, includes:

a) a container including a neck threaded externally and a container extending in an axial direction with a side wall and forming a cavity for the conditioning of the said cosmetic product, b) an applicator of the said cosmetic product including an internally-threaded head so as to cooperate with the said neck by screwing to ensure a sealed closing of said container, a stem attached by its upper extremity to the said head and by its lower extremity to a means of application, said means of application immersed typically in the said container when the said head is screwed to the said neck.

It is characterized in that the distributor applicator also includes c) a hollow exterior envelope with at least one opening and to the inside of which the said container is fixed in a removable way and d) a hollowed-out cover with at least one opening and inside which the said applicator of the cosmetic product is fixed in a removable way.

According to the invention, the container and the applicator form a refill whereas the outside envelope and the cover form an outside container.

According to various preferred embodiments of the invention:

the respective outer and inner surfaces of the container and the outer envelope have second complementary reversible fastening means;

the said fastening means are means of clipping cooperating by axial joining;

the said means of clipping are made up of at least one groove cooperating with at least one rib;

the respective outer and inner surfaces of the container and of the outer envelope have also second means of making the outer envelope and the container interdependent to rotation in the axial direction;

the said second means are hollows cooperating with corresponding lugs;

the respective outer and inner surfaces of the applicator and the cover have second complementary reversible means of fastening;

the said second means of fastening are second means of clipping cooperating by axial joining;

the said second means of clipping are made up of at least one groove cooperating with at least one rib;

the respective outer and inner surfaces of the applicator and the cover have also second complementary means rotating around the axial direction of the applicator and the cover;

the said second complementary means are axial grooves cooperating with corresponding axial lugs;

the container is inserted in the said outer envelope by an upper opening, the neck of the container overlapping this said upper opening after insertion;

the upper opening is the only opening of the outer hollow envelope;

the outer envelope is made up of a hollow tubular lateral skirt and of a strut closing a lower opening of the said hollow tubular lateral skirt, this strut may comprise a means of guiding and maintaining the container in position;

the container has the means of fastening to an upper extremity near the neck and the outer envelope has the means of fastening to an upper extremity near to the said upper opening;

the said container to a substantially tapered form, the cross section of the container decreasing away from the neck; and the fastening means and the second fastening means are designed so that the force of attachment between the container and the outside envelope is less than the force of attachment between the applicator and the cover, which helps the holding of the various parts for replacement of the container.

This distributor applicator allows solving of posed problems. In effect, it is of a simple design since there is no need to worry about the compatibility between the mascara formulae and the material that makes up the outside-visible surface of the distributor applicator. It also allows recycling of the outer envelope for possible reuse, but also because its composition is less complex and thus more easily recyclable.

Standardization is possible for manufacture of the containers and to limit production costs. Clipping of the elements is easy and allows easy handling by the user and by the person on an assembly line.

Moreover, the container hook in the outer envelope in the upper part near the upper opening of the outer envelope allows scope to play with the shape of the bottom of the outer envelope.

Also the distributor applicator according to the invention adapts to the ergonomy or the design sought by the user.

The invention extends also to a refill for typical fluid or pasty cosmetic products and to a distributor applicator outer casing for cosmetic products; refills and outer casing may be sold separately.

The invention will be better understood through the following description and the appended figures given as a non-limiting example.

DETAILED DESCRIPTION OF THE INVENTION

Figure 1A:
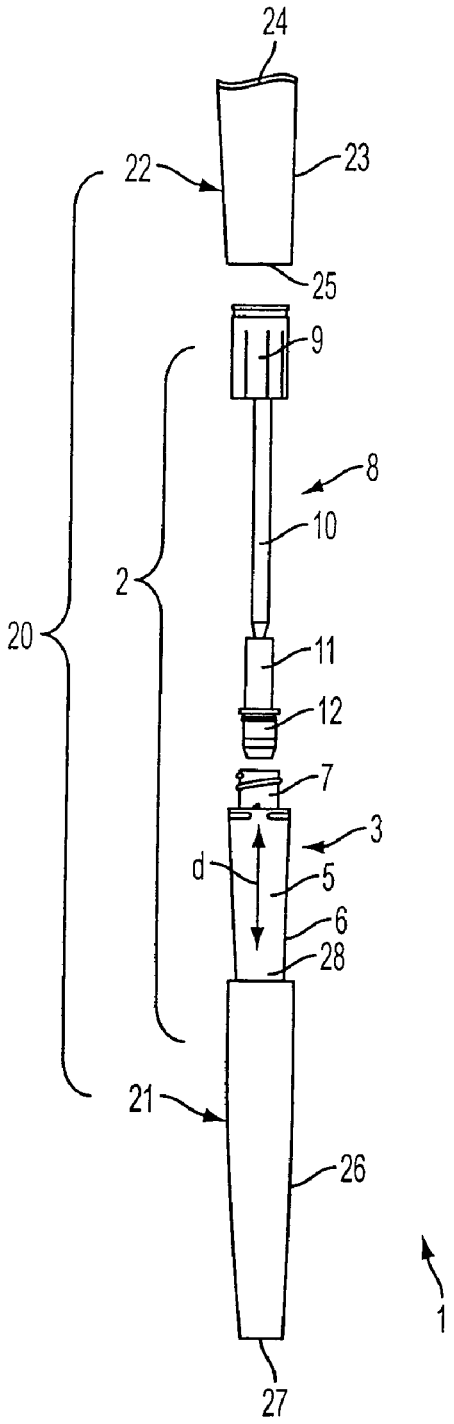
FIG. 1A is an exploded front view of a distributor applicator according to the invention; the assembly is shown by the layout of the various pieces, one on top of the other, of the distributor applicator.

A distributor applicator 1 of cosmetic product according to the invention, for example visible in exploded view in FIG. 1A, is made up of a refill 2 and of an outer casing 20 to contain the said refill 2 so as to obtain an esthetic distributor applicator that conforms to the visual standards of commercial products.

The refill 2 is more particularly made up of a container 3 including a chamber 5 forming a cavity for holding said cosmetic product, the chamber 5 extending in an axial direction shown by d and having a side wall 6 and at its so-called upper extremity an outside-threaded neck;

b) an applicator 8 of the said cosmetic product including an internally-threaded head 9 so as to cooperate with the said neck 7 by screwing to ensure a sealed closing of said holder 3, a stem 10 attached at its upper extremity to the said head 9 and by its lower extremity to a means of application 11, said means of application immersing typically in the said holder when the said head 9 is screwed to said neck 7; and a wiper 12 inserted and blocked by clipping, welding or gluing inside the neck 7 of the container and destined to wring out the means of application 11 each time it is pulled out of the chamber so as to adjust the amount of cosmetic product applied.

Figure 1B:
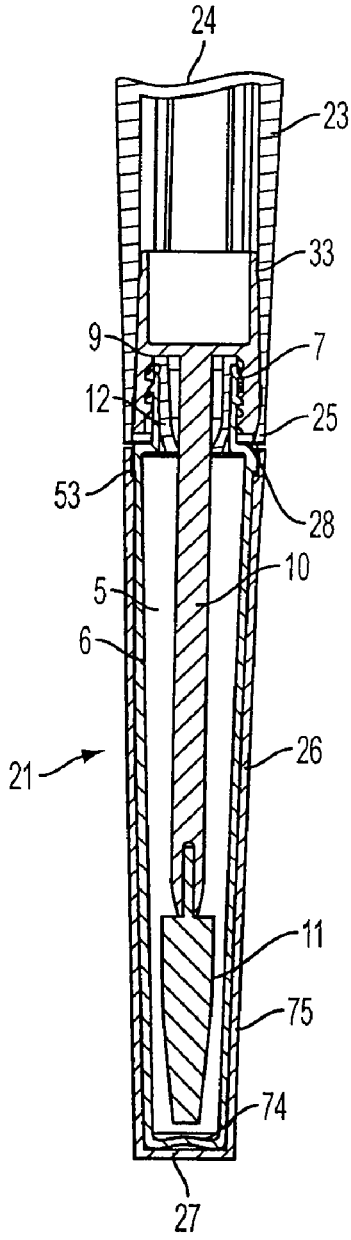
FIG. 1B is an axial cross-section of the distributor applicator according to the invention illustrated in FIG. 1A.

As shown in FIG. 1B, the stem 10 and the head 9 of the applicator 8 may typically be made from one piece, particularly by plastic molding. Moreover, the wiper may also be an integral part of the chamber 3.

The outer container 20 of the distributor applicator according to the invention is more particularly made up of an outer envelope 21 that surrounds at least laterally the side wall 6 of the holder 3 and of a cover 22 to cover the head 9 of the applicator 8.

As shown in FIG. 1B, the cover 22 is hollow and has more particularly a side wall 23, a bottom 24 forming the ridge of the distributor applicator 1 and a lower opening 25 allowing insertion of the head 9 of the applicator 8 inside the hollow. The outer envelope 21 is also hollow and has a side wall 26, a bottom 27 forming the foot of the distributor applicator 1 and an upper opening allowing insertion of the chamber 3 inside the recess.

The outer casing allows realization of an esthetic distributor applicator that may be personalized, and hides visual imperfections resulting from manufacture of the refill 2. The refill 2, in its rough state, may be considered as a distributor applicator of basic design, i.e. with no colored exterior finish, brilliance, gilding, shape etc. and may be used on its own for reasons of economy.

According to the invention, this refill has new and specific technical characteristics aimed at reversible fastening of the applicator 8 and the chamber 3 respectively inside the cover 22 and the outside envelope 21.

The head 9 of the applicator has on its lateral outside surface a fastening element 31 cooperating by axial joining with a complementary fastening element 32 arranged on the inside surface of the side wall 23 of the cover 22, the two fastening elements 31,32 forming a reversible axial means of fastening 33. More particularly, this reversible fastening is done by clipping after a translation movement according to the axial direction of the head 9 in relation to the cover 22. The head 9 of the applicator also has on its outside lateral surface an anti-rotation element 41 cooperating after insertion of the head in the cover with an complementary anti-rotation element 42 arranged on the inside surface of the lateral wall 23 of the cover 22, the two anti-rotation elements forming an anti-rotation system that may be made interdependent in rotation around the axial direction of the cover 22 and the applicator 8.

Figure 5A:
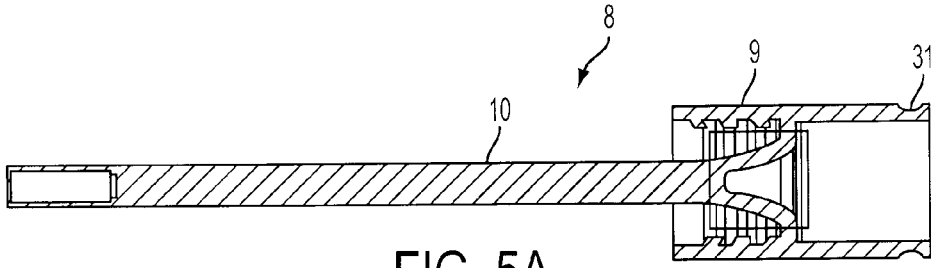
FIG. 5A is a cross-section of a stem interdependent of an applicator head according to the invention.
Figure 5B:
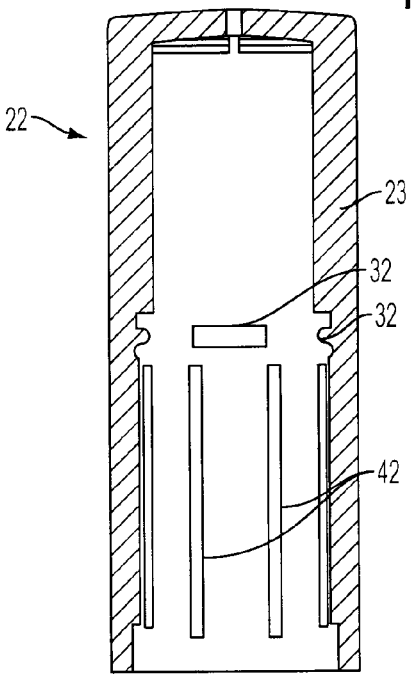
FIG. 5B is an axial cross-section of a cover according to the invention.
Figure 5C:
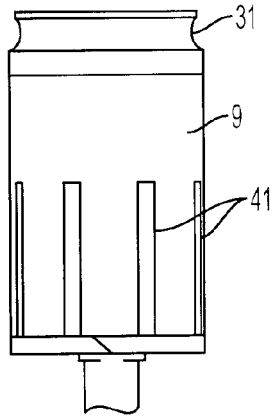
FIG. 5C is a front view of an applicator head according to the invention.
Figure 5D:
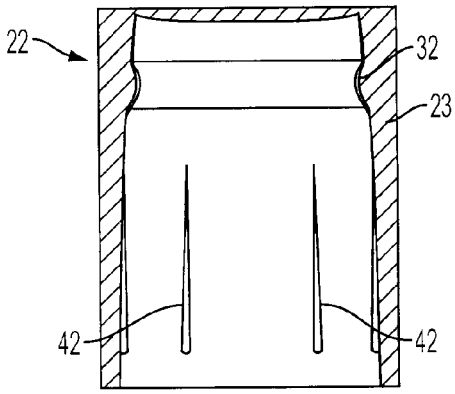
FIG. 5D is an axial cross-section of a cover according to the invention.
Figure 5E:
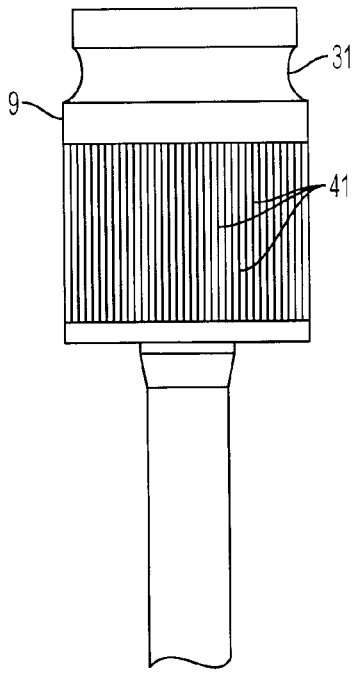
FIG. 5E is a front view of an applicator head according to the invention.

FIGS. 5B/5C and FIGS. 5D/5E illustrate two particular examples of reversible axial fastening means and of anti-rotation systems for assembly of the applicator and the cover.

The means of fastening and the anti-rotation systems are of the male/female or rib/groove type.

In FIGS. 5B/5C:

the fastening element 31 of the applicator is made up of a groove or circular groove hollowed radially and extending on the whole outer circumference of the head at the upper extremity of the head 9 and the fastening element 32 of the cover is made up of a plurality of ribs, and particularly four, distributed around the inner circumference of the side wall 23 and projecting radially beyond the inner surface of the side wall;

the anti-rotation element 41 of the applicator is made up of a plurality of lugs, distributed around the circumference of the head 9 and extending radially beyond the outer lateral surface of the head 9 and in the axial direction, and the anti-rotation element 42 of the cover is made up of a plurality of grooves, particularly six, distributed around the inner circumference of the lateral wall 23, extending in the axial direction and hollowed radially in the inner surface of the side wall;

so that when the head of the applicator is inserted in the cover, the ribs 32 engage in the groove 31 and the lugs 42 engage the grooves 42.

In FIGS. 5D/5$^{E}$:

the fastening element 31 of the applicator is made up of a groove or circular groove hollowed radially and extending around the whole outer circumference of the head 9 at the upper extremity of the head and the fastening element 32 of the cover 22 is made up of a circular rib extending around the inner circumference of the side wall 23 and projecting radially beyond the inner surface of the side wall;

the anti-rotation element 41 of the applicator is made up of radial serrations extending in an axial direction around the circumference of the head 9, and the anti-rotation element 42 of the cover is made up of a plurality of lugs, more particularly six, distributed around the inner circumference of the side wall, extending in the axial direction and projecting radially towards the center beyond the inner surface of the side wall 23;

so that when the head of the applicator is inserted in the cover, the circular rib engages the circular groove and the lugs engage between the teeth of the serrations.

The container 3 has on the outer surface of its side wall 6 at the upper extremity of the side wall 6, a fastening element cooperating by axial joining with a complementary fastening element 52 arranged on the inner surface of the side wall 26 of the outer envelope 21, of the two fastening elements 51,52 forming a reversible axial means of fastening 53. More particularly, this reversible fastening is done by clipping according to a translation movement in the axial direction of the container 3 in relation to the outer envelope 21. The container 3 also has on the outer surface of its side wall 6 an anti-rotation element 61 cooperating after insertion of the container in the outer envelope 21 with a complementary anti-rotation element 62 arranged on the inner surface of the side wall 26 of the outer envelope 21, the two anti-rotation elements forming an interdependent anti-rotation system, in rotation around the axial direction of the outer envelope 21 and the container 3, i.e. preventing relative rotation of the envelope around the container around the said axial direction.

Figure 6A:
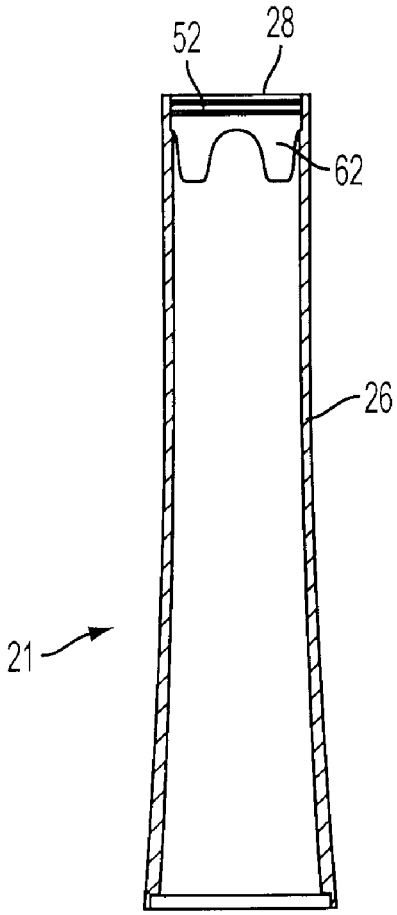
FIG. 6A is an axial cross-section of an outer envelope according to the invention.
Figure 6B:
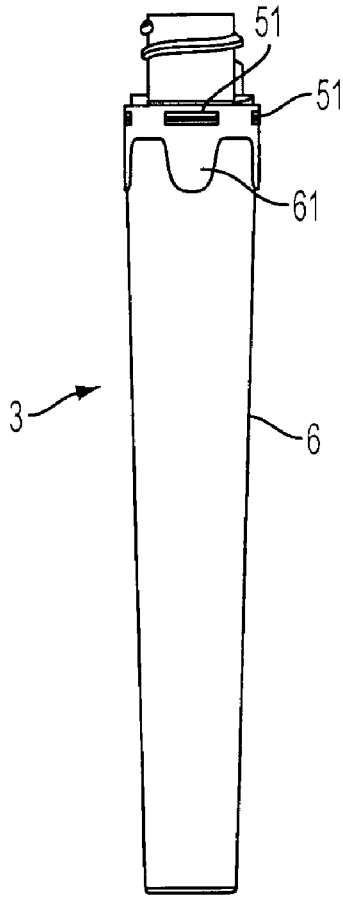
FIG. 6B is a front view of a container according to the invention.

FIGS. 6A and 6B illustrate a particular example of a reversible axial means of fastening and of an anti-rotation system for the assembly of the container 3 of the outer envelope 21. The means of fastening and the anti-rotation systems are of the male/female or rib/groove type.

The fastening element 52 of the outer envelope 26 is made up of a groove or a circular groove hollowed radially in the inner surface of the side walls 26 and extending over all the inner circumference of the outer envelope 21 at the upper extremity of the side wall 26, i.e. near (less than 1 cm) the upper opening 28 and the fastening element 51 of the container 3 is made up of a plurality of ribs, particularly four, distributed around the outer circumference of the side wall 6 and projecting radially beyond the outer surface of the side wall 6.

The anti-rotation element 61 of the container 3 is more particularly made up of a lug motif in the form of a wave on the outer circumference of the side wall 6 and the anti-rotation element 62 of the outer envelope 21 is made up of a hollow motif in the form of a wave on the inner circumference of the side wall 26.

When the container 3 is inserted in the outer envelope 21, the ribs 51 engage in the groove 52 and the hollow motifs in the form of waves 62 and in lugs 61 engage in such a way as to prevent any rotation around the axial direction of the container 3 in relation to the outer envelope 21.

Figure 7A:
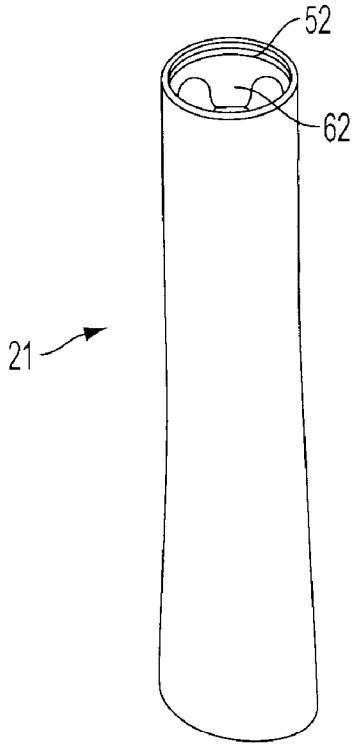
FIGS. 7A, 7B and 7C are perspective views of, respectively, an outer envelope, a container and a stem interdependent of an applicator head according to the invention.
Figure 7B:
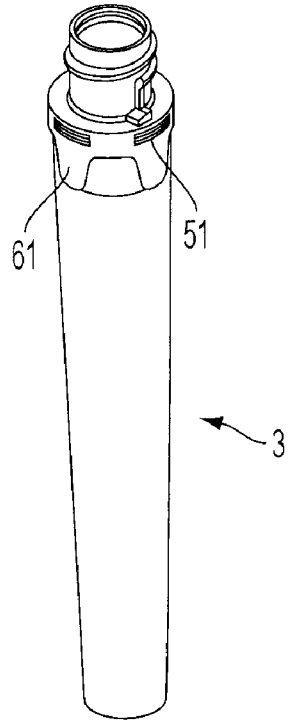
Figure 7C:
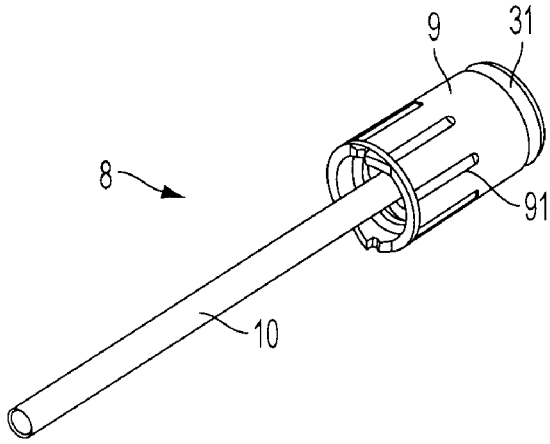

FIGS. 7A, 7B and 7C illustrate from another angle, respectively, an outer envelope 21, a container 3 and a head 9 interdependent of a stem 10 of an applicator 8 according to the invention with their fastening and anti-rotation elements.

Figure 4A:
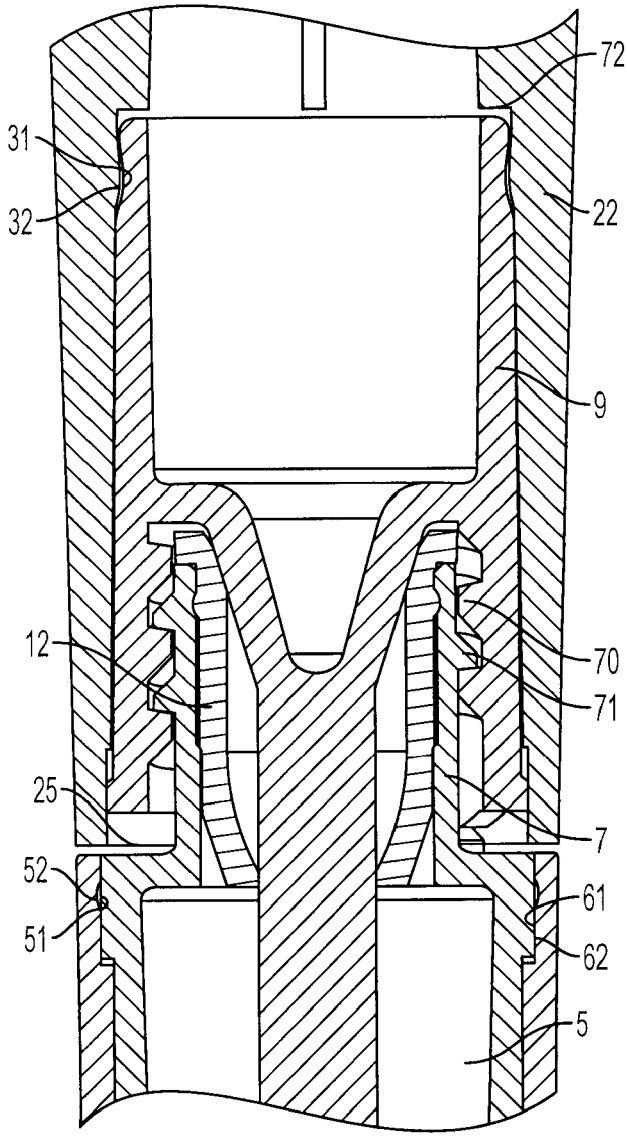
FIG. 4A is an enlarged section of a portion of the distributor applicator according to the invention.

FIG. 4A is a large-scale drawing of a part around the neck 7 of the distributor applicator 1 in closed position, to clearly show the overlapping of the various parts that make up the distributor applicator 1 according to the invention.

The head 9 of the applicator 8 has an internal thread 70 screwed onto an external thread 71 formed on the neck 7. A wiper 12, in polyethylene or elastomer, is fastened to the inside of the neck and the head 9 of the applicator is supported on the wiper 12 when the applicator 8 is screwed on the container 3 in such a way as to formed a sealed closing of the chamber 5. The head 9 of the applicator 8 is inserted in the cover 22 by the lower opening 25 of the cover until the axial fastening elements 31,32 clip into place. The applicator head is particularly hollow on the transverse section at the fastening element 32 level so as to confer increased elastic properties to the head 9 to facilitate clipping. The anti-rotation system is not visible in FIG. 4A. An axial stop 72 may moreover be formed in the cover so as to prevent too deep an insertion of the head in the cover. The container 3 is inserted in the outer envelope 21 through the upper opening 28 of the outer envelope, the container bottom first, until the axial fastening elements 51,52 clip into place, so as to let the neck 7 extend over the upper opening 28. An axial stop may moreover be formed between the anti-rotation element 61 projecting on the container 3 and the hollow anti-rotation element 62 in the outer envelope so as to prevent too deep an insertion of the container in the outer envelope.

Once assembled, the cover 22 and the applicator 8, respectively the outer envelope 21 and the container 3, are perfectly interdependent, i.e. there is no movement of one relative to the other until the user decides to detach them. And during common opening and closing distributor usage movements of the distributor applicator 1, the user holds the cover 22 in one hand and the outer envelope 21 in the other, and exerts a relative rotating movement around the axial direction of the cover relative to the outer envelope. With anti-rotation systems, this translation movement is integrally transmitted to the applicator 8 and the container 3 so that these two screw or unscrew.

Figure 4B:
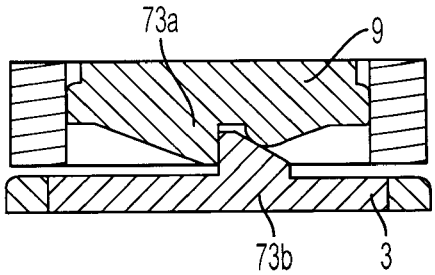
FIG. 4B illustrates a blocking system preventing rotation of the distributor applicator in the container when the distributor applicator is in a closed position.

The neck 7 and the head 9 also have means of blocking 73*a*, 73*b* shown in FIG. 4B cooperating to prevent an involuntary opening of the distributor applicator, for example in the user's handbag, and to interrupt the screw travel.

Figure 2A:
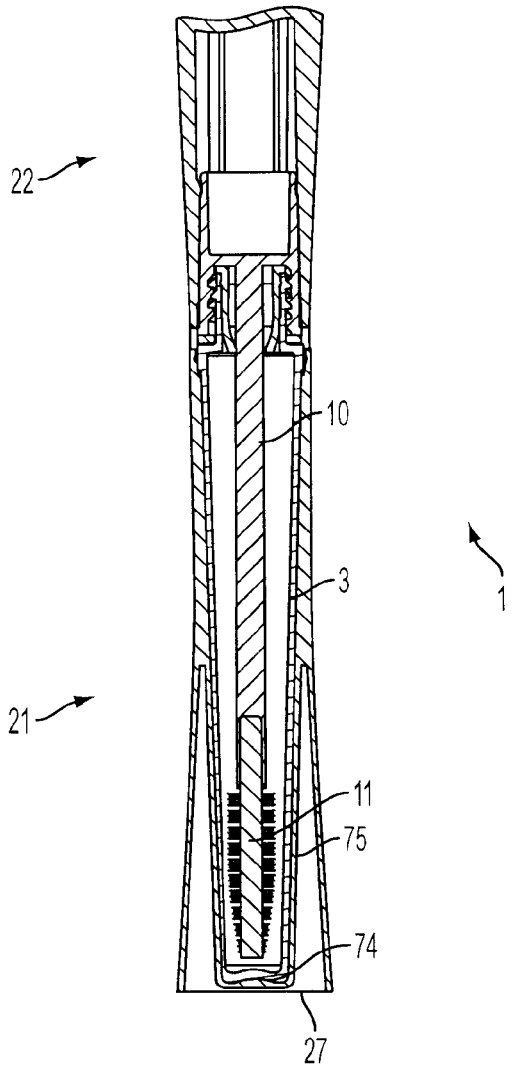
FIGS. 2A and 2B are axial cross-sections of an embodiment according to the invention, differing from the embodiment of FIG. 1B in the shape of the outer envelope.

In the case where the outer envelope and the cover show no symmetry of total revolution around the axial direction, for example if the outer envelope has an elliptical bottom 27 and the cover also has an elliptical bottom 24, as shown in FIG. 2A, it is possible to plan to make the container/outer envelope and applicator/cover combinations mistake-proof so as to correctly orient the outer envelope relative to the cover when the distributor applicator is closed, and in the example of the elliptical bottoms 27 and 24.

To detach the refill 2 from the outer container 20, for example to change the refill, the user takes the cover 22 in one hand and the outer envelope 21 in the other when the distributor applicator is in a closed position, which fortunately prevents all unfortunate soiling, and exerts a strong traction in the axial direction. Fortunately, the coupling force between the cover 22 and the applicator 8 is greater than the coupling force between the outer envelope 21 and the container 3 so that it is the outer envelope 21 that detaches first from the container 3, i.e. the fastening mechanisms 51 and 52 disengage. The user then takes the cover 22 in one hand and the container 3 in the other, leading to once more exerting a strong traction in the axial direction. The cover 22 then detaches from the applicator 8, i.e. the fastening mechanisms 31 and 32 disengage.

It is thus possible to install a new refill 2 inside the outer container 20 or to install the refill 2 just removed in another outer container. Thus, according to the invention, the use of refills allows a reduction in costs, and the possible adaptation of said refill on different outer containers allows a personalization of the outer aspect of the distributor applicator.

Since the outer envelope 21 is not in contact with the cosmetic product, it is not necessary to worry about constraints of compatibility between the cosmetic product and the material comprising the outer envelope 21, and the design of the outer casing 21 is simplified and it is simple to obtain the desired finish, for example as regards the shape or the visual aspect. The constraints of compatibility between the cosmetic product and the materials comprising the refill 2 are also easy to respect since the outer appearance of the refill is unimportant. The refill may for example have barrier properties to solvents or to the air. This constraint limitation allows the use of low-cost materials.

Figure 2B:
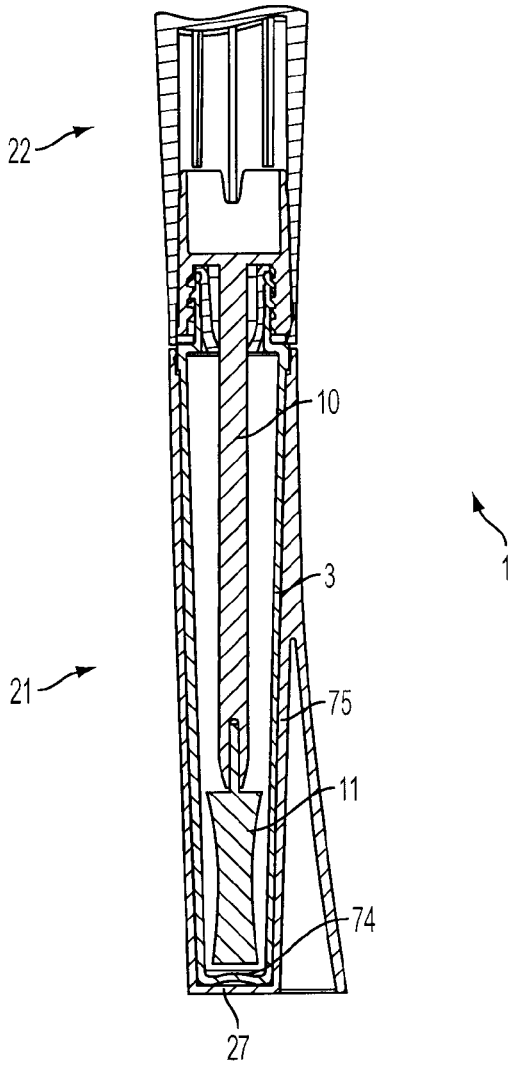

It is thus possible to use a simple design and appearance of the outer casing and to obtain original shapes, curved for example. Also, FIGS. 1B, 2A and 2B show outer envelopes 21 of different shapes, particularly at the bottom 27. The diameter of the container 3 decreases favorably down to the foot 74 in such a way as to give greater freedom in the possibilities of the outer shapes of the outer envelope 21. Fastening of the container 3 in the outer envelope 21 is better done in the upper part of the outer envelope 21, respectively of container 3, and the container inserted in the outer envelope 21 through the upper opening 28 in order to leave a greater number of possibilities for the outer shapes of the outer envelope.

As shown in FIGS. 1B, 2A and 2B, the outer envelope has also an inner skirt 75 following the shapes of the container 3 in such a way that the container stays perfectly in the outer envelope 21, i.e. the inner volume of the inner skirt corresponds to the volume of the container. FIGS. 1B, 2A and 2B also show different types of applicator 8, of foam, brush type. The means of application 11 may be an application end piece with a part called central cooperating by its extremity with the said stem 10 to its lower extremity, typically by clipping, and a part called peripheral to take out a small amount of said product with a view to its application. The said end piece may be an application material of the cellular or fibrous type attached to a support, or a brush with a metallic twist as a support and a plurality of bristles as an application material, or a plastic-molded part with typically a plurality of parts in relief or projections, and/or hollows or cavities.

Figure 3A:
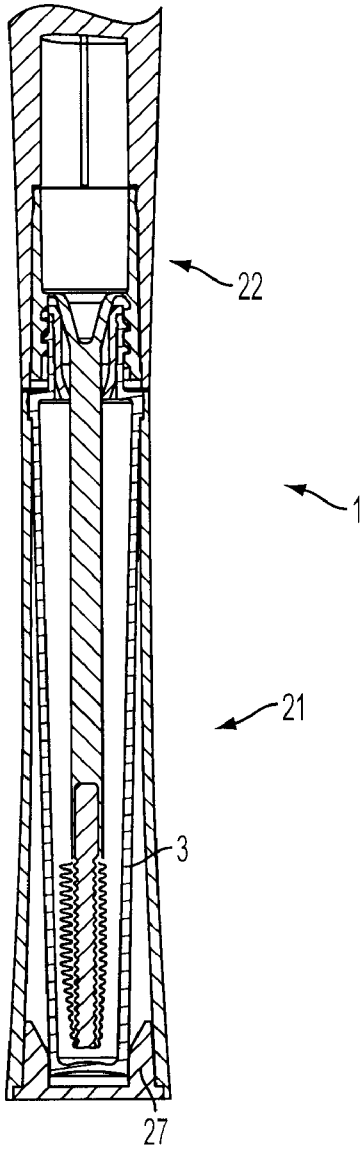
FIG. 3A is an axial cross-section of an embodiment according to the invention differing from the embodiment of FIG. 2A in the two-part design of the outer envelope.
Figure 3B:
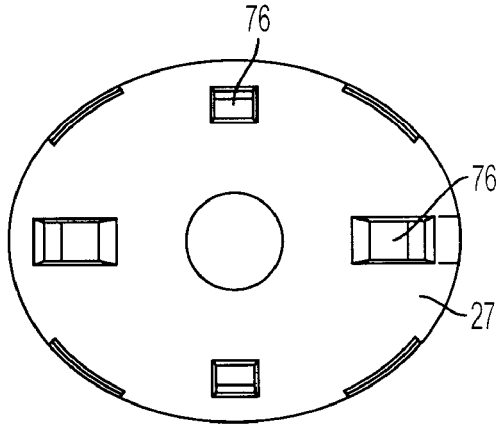
FIGS. 3B, 3C and 3D illustrate the bottom part of the outer envelope of FIG. 3A.
Figure 3C:
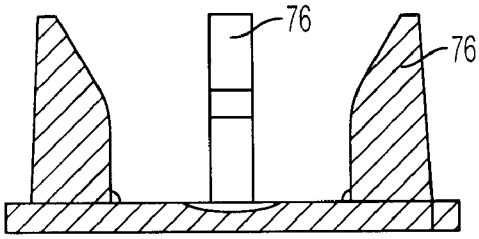
Figure 3D:
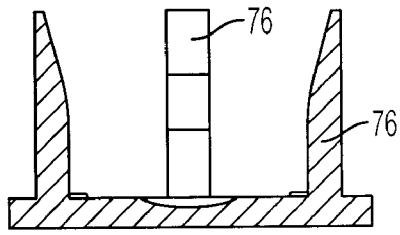

As shown in FIG. 3A, the outer envelope 21 may consist only of a hollow tube open at both axial extremities. The bottom 27 may thus be made of an additional part or strut to be fastened, typically by clipping, welding or gluing, on the inner surface of the hollow tube at the bottom extremity. This additional part also has extensions 76 or means of guiding and keeping the container extending in the axial direction and keeping the container by the outer envelope so as to avoid any displacement or radial play of the container 3 in the outer envelope 21. The container is then fastened by its upper extremity to the outer envelope with the means of fastening 51,52 and kept in the axis with the said extensions 76.

In a distributor applicator according to the invention:

a) the dimension in the axial direction d of the distributor applicator may go from 40 mm to 170 mm, $_B$ab) the dimension according to the axial direction d of the container may go from 30 mm to 150 mm, c) the greatest radial dimension of the distributor applicator may go from 8 mm to 25 mm d) the greatest radial dimension of the container may go from 4 mm to 21 mm.

According to the invention, it is possible to manufacture refills in great quantities since they may be compatible with a certain number of different outer containers, which has a positive impact on costs. Moreover, the outer envelopes according to the invention are of relatively simple design since they do not require the use of materials compatible with the formulation of the cosmetic product and it is thus easier to give them a perfect visual aspect. The refills may be made up mainly of polyolefins (PP, PE), and the outer container of styrenic compounds (ABS, SAN, clear ABS . . . ), copolyesters, ionomers, polyolefins.

The distributor applicator according to the invention may be sold in the form of kits with for example:

a) an outer container and several refills;

b) a refill and several outer containers so that the users may personalize their distributor applicator according to their wishes at any given time.

The invention claimed is:

1. Distributor applicator of a cosmetic product that is typically fluid or pasty, including:

a) a container including a neck threaded externally and a chamber extending in an axial direction with a side wall and forming a cavity for the conditioning of the cosmetic product, b) an applicator of the cosmetic product including an internally-threaded head so as to cooperate with the neck by screwing to ensure a sealed closing of said container, a stem attached by its upper extremity to the head and by its lower extremity to a means of application, said means of application immersing typically in the container when the head is screwed to the neck, c) a hollow outer envelope with at least one opening and having an inside wherein the container is fixed in a removable way, wherein the outer envelope comprises a hollow tubular lateral skirt having an upper opening and a lower opening, and a strut closing the lower opening of the hollow tubular lateral skirt, and d) a hollowed-out cover with at least one opening and having an inside wherein the applicator of the cosmetic product is fixed in a removable way;

wherein outer and inner surfaces respectively of the container and of the outer envelope have complementary reversible first means of fastening, wherein outer and inner surfaces respectively of the applicator and the cover have reversible complementary second means of fastening, and wherein the first means of fastening and the second means of fastening are designed so that an attachment force between the container and the outer envelope is less than an attachment force between the applicator and the cover.

2. Distributor applicator according to claim 1, wherein the first means of fastening are first means of clipping cooperating by axial joining.

3. Distributor applicator according to claim 2, wherein the second means of fastening are second means of clipping cooperating by axial joining

4. Distributor applicator according to claim 3, wherein the second means of clipping comprise at least one groove cooperating with at least one rib.

5. Distributor applicator according to the claim 2, wherein the first means of clipping are made up of at least one groove cooperating with at least one rib.

6. Distributor applicator according to claim 1, wherein respective outer and inner surfaces of the container and the outer envelope also have complementary means for making the outer envelope and the container interdependent in rotation around the axial direction.

7. Distributor applicator according to claim 6, wherein the complementary means are hollows cooperating with corresponding lugs.

8. Distributor applicator according to claim 1, wherein respective outer and inner surfaces of the applicator and the cover have also second complementary means for making the applicator and the cover interdependent in rotation around the axial direction.

9. Distributor applicator according to claim 8, wherein the second complementary means are axial grooves cooperating with corresponding axial lugs.

10. Distributor applicator according to claim 1, wherein the container is inserted in the outer envelope through the upper opening, wherein the container neck overlaps the opening after insertion.

11. Distributor applicator according to claim 1, wherein the strut has a means of guiding and keeping the container in position.

12. Distributor applicator according to claim 1, wherein the inner volume of the outer envelope corresponds to the volume of the container.

13. Distributor applicator according to claim 1, wherein the container has the first means of fastening to an upper extremity near the neck and the outer envelope has the first means of fastening to an upper extremity near the upper opening.

14. Distributor applicator according to claim 1, wherein the container has a substantially tapered shape, the cross section of the container decreasing away from the neck.

* * * * *